United States Patent [19]

Umezawa et al.

[11] 4,179,116

[45] Dec. 18, 1979

[54] SEPARATING MECHANISM

[75] Inventors: Kazumi Umezawa, Kawasaki; Hiroyuki Hattori, Inagi; Hiroshi Ogawa, Kawasaki; Hirotoshi Kishi, Tokyo; Seiji Sagara, Kawasaki, all of Japan

[73] Assignee: Canon Kabushiki Kaisha, Tokyo, Japan

[21] Appl. No.: 919,148

[22] Filed: Jun. 26, 1978

[30] Foreign Application Priority Data

Jul. 8, 1977 [JP] Japan ..... 52/81569

[51] Int. Cl.[2] ..... B65H 29/54

[52] U.S. Cl. ..... 271/306; 271/DIG. 2

[58] Field of Search ..... 271/174, DIG. 2; 432/60; 118/60, 245

[56] References Cited

U.S. PATENT DOCUMENTS 3,912,256 10/1975 Nagahara ..... 271/DIG. 2 X 3,936,045 2/1976 Ariyama ..... 271/DIG. 2 X

*Primary Examiner*—Richard A. Schacher

*Attorney, Agent, or Firm*—Fitzpatrick, Cella, Harper & Scinto

[57] ABSTRACT

This specification discloses improvements in a separating mechanism for forcibly separating transfer medium from an image bearing member after the visible image on the image bearing member has been transferred to the transfer medium. In the separating mechanism having a separation guide disposed between the image bearing member and a side edge of the transfer medium to direct the transfer medium away from the image bearing member, the separation guide has one end as a supported end and the other end as a free end and the free end of the separation guide is supported from the non-image bearing member side by a keep member and from the image bearing member side by a release member. Thus, the separating mechanism of the present invention can readily and positively effect treatment of jammed transfer medium which would be attributable to abnormal transport of the transfer medium, by a simple construction.

9 Claims, 8 Drawing Figures

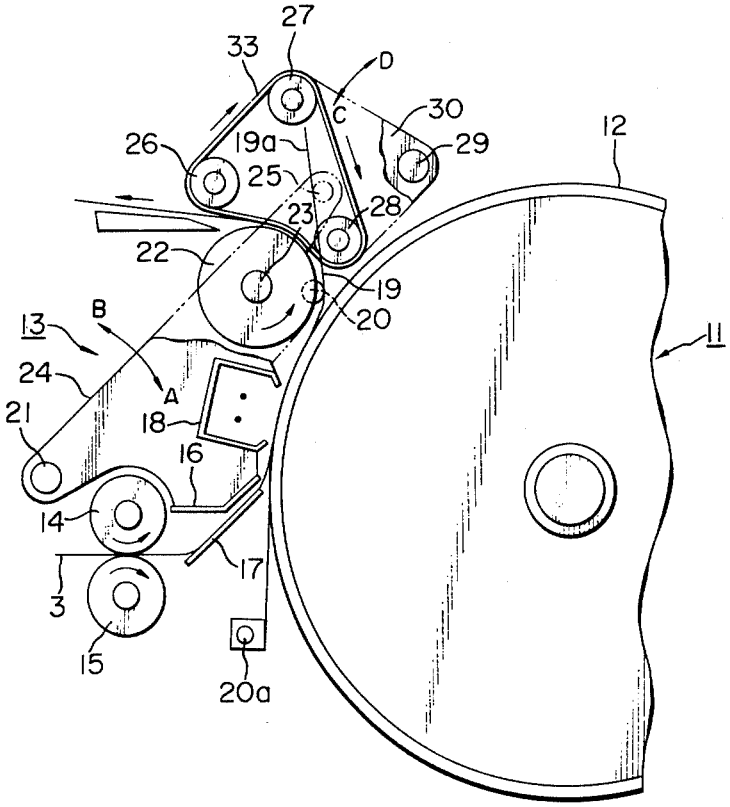

SEPARATING MECHANISM

BACKGROUND OF THE INVENTION

1. Field of the Invention

This invention relates to a separating mechanism for forcibly separating transfer medium from an image bearing member after the visible image on the image bearing member has been transferred to the transfer medium.

2. Description of the Prior Art

Generally, in the image formation apparatus utilizing electrophotography such as an electrophotographic copying apparatus, a photosensitive medium having a photoconductive layer shaped in the form of a drum, for example, is used as the electrostatic latent image bearing member to form a copy image of an original thereon as the photosensitive medium is rotated. In such an apparatus, charging means, exposure means and developing means are disposed around the rotating photosensitive medium to form an electrostatic latent image corresponding to the original image and the latent image is developed by toner particles. The visible image obtained by the development on the photosensitive medium is then transferred to transfer medium such as plain paper or the like and fixed on such transfer medium for utilization. On the other hand, after the image transfer has been effected, the photosensitive medium is cleaned by cleaning means to remove any residual developer therefrom for reuse in the next cycle of copy image formation.

To transfer the developer to the transfer medium during the image transfer, it is necessary to have an effect on the electric field by the use of voltage application means such as corona discharger, roller electrode or the like. Corona discharger is widely used as such voltage application means, but when charge is so imparted to the transfer medium, the charge and the latent image on the photosensitive medium attract each other intensely, so that the transfer medium is brought into strong intimate contact with the photosensitive medium. Such intimate contact is necessary for the toner particles to be transferred to the transfer medium without being disturbed during the image transfer step. However, after completion of the image transfer step, the transfer medium must be forcibly separated from the photosensitive medium by some separation means in order to direct the transfer medium to the fixing means. Heretofore, vacuum suction system, a compressed air blower system whereby pressurized air may be blown through a nozzle, or other blower means have been employed as the means for separating the transfer medium brought into strong intimate contact with the photosensitive medium. The separating mechanism using the compressed air requires a compressor, pump or other machine and a conduit for directing the compressed air to a set position. As a result, various problems occur such as bulkiness of the image formation apparatus, higher cost of manufacture and even the generation of noise.

A solution to the problems occuring to the separating mechanism using compressed air is a separating system utilizing a separation belt as shown in FIG. 1 of the accompanying drawings. FIG. 1 shows a side view of an example of the separating mechanism using a belt. In the Figure, reference numeral 1 designates a drum-shaped photosensitive medium (hereinafter referred to as the photosensitive drum) which is rotatable in the direction of the arrow. Designated by 2 is a separation guide which is a metal plate provided at a position whereat the end of the transfer paper 3 overlaps the end of the photosensitive drum. The base of the separation guide 2 forms a fixed end 2*a* fixed as shown and the other end is a free end 2*b* which is spaced apart from the peripheral surface of the drum. Denoted by 4 is a separation roller formed by a rotatable roller extending parallel to the rotational axis of the photosensitive drum. At the location of the separation roller 4 corresponding to the separation guide 2, an endless belt 8 passed over pulleys 5, 6 and 7 is urged against the roller 4 as shown. The separation roller 4 and the separation belt 8 are rotated in the direction of the arrows to guide and separate the transfer medium in the direction of arrow 10.

According to the above-described separation mechanism, it is possible to separate the transfer medium from the photosensitive drum by a simple construction. In such construction, however, when abnormal transport of transfer medium occurs at the image transfer position or the separating position, great difficulties are encountered in treating the transfer medium because the separation guide 2 is fixed. Also, the mounting or dismounting of the drum 1 with respect to the apparatus body could not be effected quickly because the separation guide 2 is urged against or fixed adjacent to the drum 1.

SUMMARY OF THE INVENTION

It is an object of the present invention to provide a separating mechanism for properly separating transfer medium from an image bearing member.

It is another object of the present invention to provide a separating mechanism which enables any jam of transfer medium arising from abnormal transport thereof to be readily and positively treated.

To achieve these objects, the present invention provides a separation guide disposed between an image bearing member and a side edge of transfer medium to direct the transfer medium away from the image bearing member, said separation guide being disposed adjacent to or in contact with said image bearing member with one end thereof as a supported end and the other end as a free end, a keep member adapted to bear against the free end of the separation guide from the non-image bearing member side and a release member adapted to bear against the free end of said separation guide from the image bearing member side, said free end of said separation guide being supported by said keep and release members.

The invention further provides that the separation guide, the keep member and the release member are installed on a first support plate pivotally mounted to a fixed shaft, the separation belt is installed on a second support plate pivotally mounted to another fixed shaft, whereby said support plates are pivotally movable between inoperative positions and operative positions adjacent to the transport path of the transfer medium.

In the separating mechanism of the present invention, a separation roller is provided at a position for nipping transfer medium guided by a separation guide provided between the transfer medium and the image bearing member and at the end of the transfer medium. This separation roller has its peripheral surface disposed in proximity or in contact with the image bearing member surface on the surface of the image bearing member corresponding to the separation guide and on the extension thereof. The separation mechanism further has, for example, a separation belt or auxiliary rollers rotatable in contact with the separation roller for nipping transfer medium between it and the separation roller to separate and transport the transfer medium.

The term "image bearing member" used herein is intended to include an insulating drum, a photosensitive medium, electrostatic recording paper, etc. A drum shape is preferred for this image bearing member in terms of holding of the image back-up layer and mechanism, but this is not restrictive. The transfer medium is intended to include paper, cloth, film, vinyl sheet and the like on which recording can be made.

The invention will become more fully apparent from the following detailed description taken in conjunction with the accompanying drawings.

DESCRIPTION OF THE PREFERRED EMBODIMENTS

Figure 1:
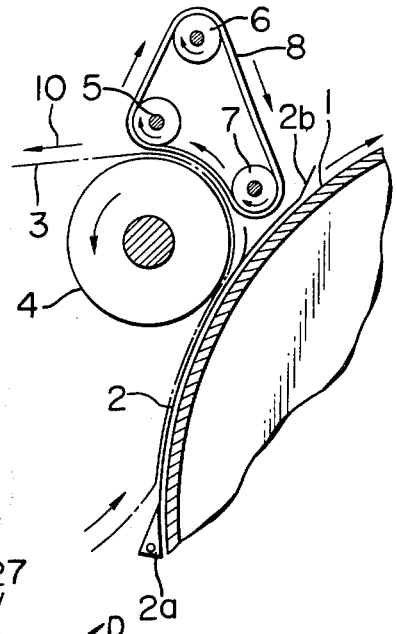
FIG. 1 PRIOR ART
FIG. 1 is a side view of the separating mechanism according to the present invention.
Figure 2:
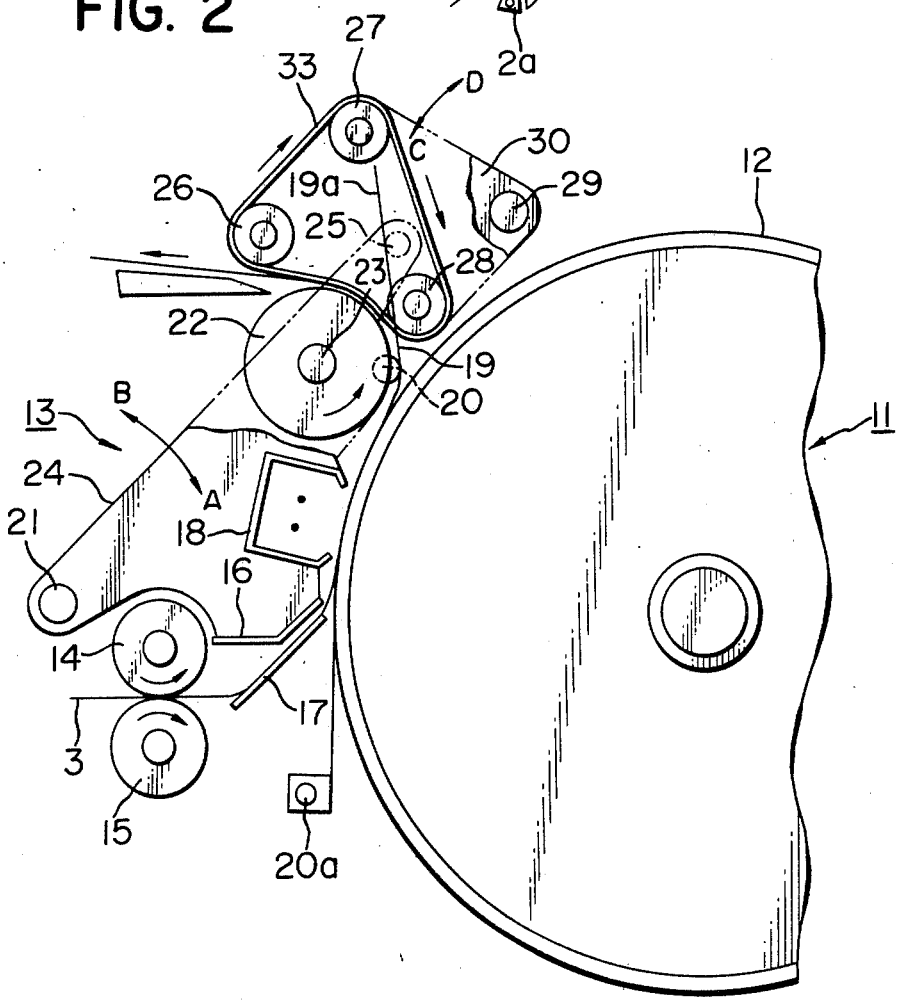
FIG. 2 is a side view of the mechanism according to an embodiment of the present invention.
Figure 3:
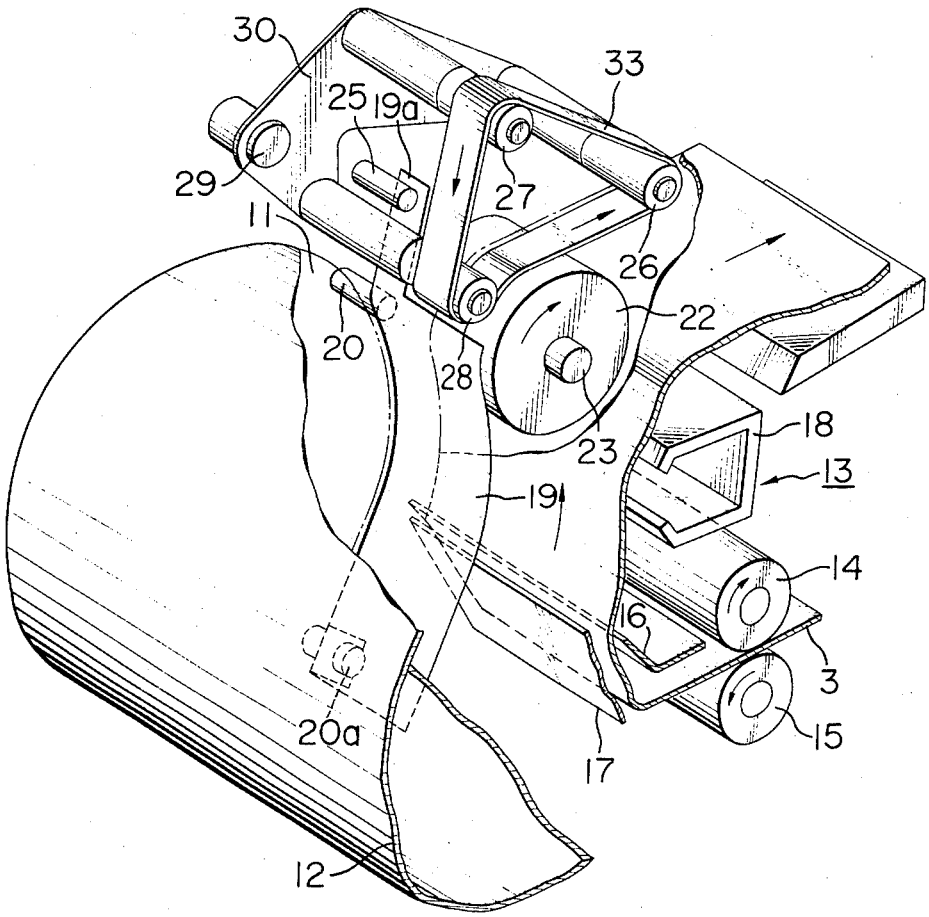
FIG. 3 is a perspective view of the FIG. 2 mechanism.

Referring to the drawings, FIG. 2 is a side view showing the separating mechanism of the present invention, and FIG. 3 is a perspective view thereof showing chiefly the image transfer station for transfer paper and the separating mechanism. In FIGS. 2 and 3, reference numeral 11 designates a photosensitive drum having a photosensitive layer 12 on the peripheral surface thereof. Disposed successively in place around the drum 11 and in the direction of rotation of the drum 11 are a corona discharger which is a latent image formation means, an exposure optical system, and a developing device which is the means for developing latent images formed on the drum surface, although these are not shown. Designated by 13 is an image transfer station wherein the developed image on the drum 11 is transferred to transfer paper 3 conveyed thereto, whereafter the transfer paper 3 is forcibly separated from the surface of the drum by separating means and passed to a fixing device (not shown). Having passed through the image transfer station, the residual developer remaining on the drum 11 may be removed by cleaning means (not shown).

In the aforementioned transfer station, transfer paper 3 conveyed thereto by transport rollers 14 and 15 in synchronism with the latent image on the photosensitive drum 11 is fed so as to make uniform contact with the surface of the drum 11 by means of the guide plate 16 and 17. The transfer paper 3 advances in the direction of the arrow and along the photosensitive drum 11 and is subjected to corona discharge for image transfer by a corona discharger 18 from the back thereof. The above-mentioned discharger for image transfer applies charges opposite in polarity to the charges of the developer particles on the photosensitive drum 11 and attracts the latter charges to the transfer paper 3, but after all, the transfer paper 3 is brought into intimate contact with the drum 11. Although such intimate contact is necessary to achieve good image transfer, it requires a very strong force after the image transfer step has been completed and in the stage wherein the transfer paper is separated from the drum 11. The present invention is a separating mechanism for forcibly separating from a latent image bearing member transfer paper or the like attracted by strong electrostatic force. The invention will hereinafter be described in detail.

In the separating mechanism of the shown embodiment, there is a separation guide 19 which is at rest inwardly of the side edge of the transfer paper 3. The separation guide 19 is formed of a sheet metal or of a sheet metal coated with a material of low friction coefficient and has flexibility. At least during the separation, as shown, the separation guide is disposed in a complementary configuration along the photosensitive drum 11 at the transfer station. In the apparatus of the illustrative embodiment, the separation guide 19 has one end thereof held on a pivotable shaft 20*a* and the other end forming a free end 19*a*, and is urged toward the photosensitive drum 11 by a roller such as the separation roller to be described and a restraining member such as separation guide keep member or release member provided adjacent to the separation roller, and automatically disposed in a predetermined condition. Thus, the separation guide 19 is pivotable about the shaft 20*a* so as to be moved into or out of contact with the photosensitive drum 11. In FIG. 2, there is shown a case where the free end 19*a* of the separation guide is held by a separation guide keep member 20 for supporting from the non-image bearing member side and by a separation guide release member 25 for supporting from the image bearing member side and the separation guide 19 is installed along the end peripheral surface of the drum 11. The above-mentioned keep member 20 and the release member 25 are securely mounted on a first support plate pivotable about a shaft 21 and supporting the aforementioned image transfer corona discharger 18 and the rotary shaft 23 of the separation roller 22 to be described and the guide plate 16. The support plate 24 is pivotable about the shaft 21 in the directions of arrows A and B (FIG. 2). When pivoted in the direction of arrow A, the support plate 24 becomes operative and when pivoted in the direction of arrow B, it becomes released. As described hitherto, the separation guide 19 having one end fixed and the other end forming a free end is urged toward the photosensitive drum 11 by the keep member 20, and the substantially central portion of the separation guide 19 corresponding to the image transfer stroke has a shape similar to or an arcuate shape approximate to the peripheral surface of the photosensitive drum 11.

Figure 4:
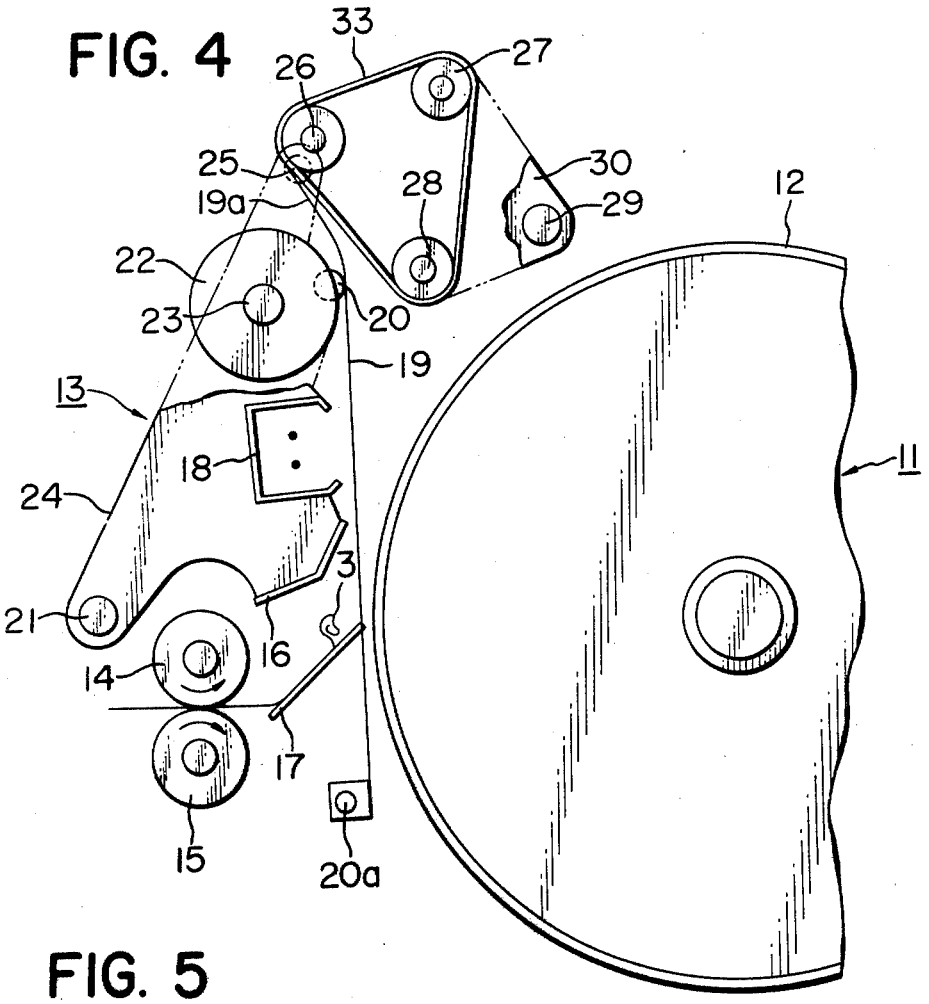
FIG. 4 is a side view showing the released condition of the transfer medium transport path in FIG. 2.

In the present embodiment, as noted above, the free end of the separation guide 19 is supported not only by the keep member 20 but also by the release member 25 which supports from the image bearing member side. More specifically, the separation guide 19 urged toward the drum 11 side by the keep member 20 has its free end bent and held away from the drum by the release member 25. Therefore, the free end 19*a* of the separation guide 19 is positively held from both sides of its free end by the keep member 20 and the release member 25. Thus, after having passed through the transfer step, the transfer paper 3 is positively directed by the separation guide 19 in the direction to be held by and between the separation roller 22 and the separation belt 25. It will be noted that part of the free end 19*a* of the separation guide 19 is provided just short of the separation belt 33. This ensures the, transfer paper 3 to be held by and between the separation roller 22 and the separation belt 33. Accordingly, the transfer paper may be prevented from deviating from its predetermined transport path to cause jam. Also, as shown in FIG. 4, when the transfer paper transport path is opened, the separation guide is quickly spaced apart from the drum 11 surface by the release member 25. Further, where the separation guide 19 is installed on the end peripheral surface of the photosensitive drum 11, the aforementioned support plate 24 may be pivoted about the shaft 21 in the direction of arrow A, whereby the separation guide 19, separation roller 22, corona discharger 18, guide plate 16, etc. may positively and quickly be installed without the necessity of cumbersome positioning.

The keep member 20 and release member 25 which support the free end of the separation guide could be provided on a support plate for pulleys, to be described, over which the separation belt is passed. The separation guide 19 turns over the side edge of the transfer paper from the photosensitive drum 11 and guides it to the separation roller 22.

In FIGS. 2 and 3, the separation roller 22 is at a position substantially corresponding to the separation guide 19 and is rotated at the same peripheral velocity as that of the photosensitive drum 11 positioned near the roller 22. The separation roller 22 may be formed of a relatively elastic material such as rubber or synthetic resin or may be formed by a solid base coated with said elastic material. The separation roller 22 takes the rotative force transmitted thereto by drive transmission means such as chain or belt or gear (not shown) and is rotated normally or in synchronism with the transfer paper.

Incidentally, a separation belt 33 passed over the pulleys 26, 27 and 28 is urged against the separation roller 22. These pulleys are provided on a second support plate 30 rotatable about the shaft 29 in the direction of arrows C and D. when rotated in the direction C, the separation belt 33 is rendered operative (FIG. 2) and when rotated in the direction D, the separation belt 33 is released (FIG. 4). FIG. 4 is a side view of the first and second support members spaced apart from the drum 11 to release the transfer medium transport path.

In the present embodiment, as described above, the construction is such that (1) the image bearing member, the separation guide and the separation roller or (2) the separation roller and the separation belt are divisible simultaneously or individually with the transfer medium transport path as the boundary.

Of course, the construction in which the division of the items (1) and (2) above is possible or the construction in which the division may be selectively accomplished may be set as required. Also, the separation guide may be automatically installed by the movement of each of the above-mentioned parts. The members supported by each of the support plates may be suitably selected and are not limited to those in the present embodiment.

The portion of the separation guide which makes contact with at least other members such as the latent image bearing member like the photosensitive drum or the transfer paper may be coated with a substance of low friction coefficient such as "Teflon" resin or polyester film which is an insulative resin, thereby increasing the durability of the image bearing member and the guide and enabling smooth transport of transfer paper during the image transfer step and the separation step.

Figure 5:
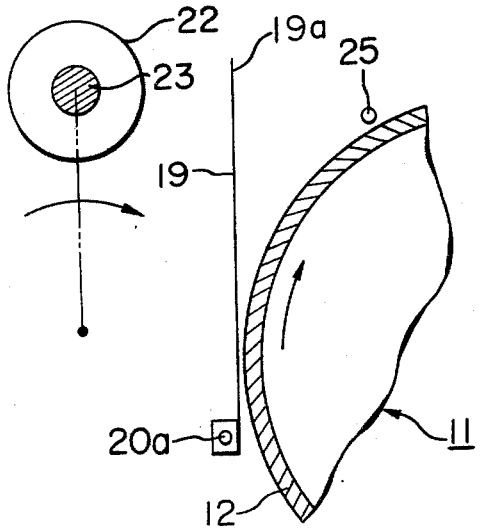
FIGS. 5 and 6 are side views showing an embodiment of the mechanism whereby the separation guide is installed.
Figure 6:
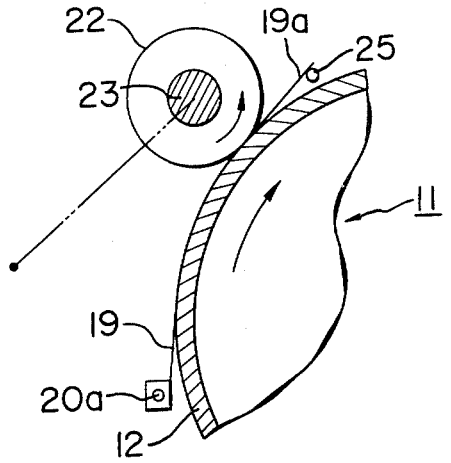

The installation mechanism of the separation guide 19 may be such as the embodiment shown in FIGS. 5 and 6. In this embodiment, the separation guide 19 is urged toward the photosensitive drum 11 side by the separation roller 22 to assume its operative position. FIG. 5 shows the side surface of the transfer station when the separation roller 22 and the separation guide 19 are released with respect to the photosensitive drum 11. By moving the separation roller 22 from the position of FIG. 5 in the direction of the arrow, the operative position of FIG. 6 may be automatically obtained. In the embodiment shown in FIGS. 5 and 6, the separation roller 22 also serves as a keep member and this simplifies the construction and eliminates the work of attachment and adjustment. In this case, the separation roller 22 is a mechanism rotated on the separation guide 19. Further, in the present embodiment, the fixed end 20*a* of the separation guide 19 and the release member 25 are fixed to the image formation apparatus body (not shown). Also, the separation roller 22 may be mounted on a support member (not shown) pivotable with other components such as corona discharger or the like. Still further, the release member 25 may be installed on the support members.

As a further alternative, the separation guide 31 may have one end secured to the second support plate 30 and the other end forming a free end, and may be supported by the keep member and the release member. Again in the present embodiment, the separation guide can be positively held and in addition, the engagement and disengagement of the separation guide with the photosensitive drum 11 may be easily accomplished. In the other points, this embodiment is similar to the embodiment of FIG. 2. That is, the keep member and the release member are provided on the first support plate.

In FIG. 2, the release member 25 is secured to the support plate 24, but alternatively it may be secured to the belt pulley support plate 30. Again in this case, the free end of the separation guide need not be bent so as to be spaced apart from the drum and moreover, the separation guide is installed to ensure positive separation to be effected. Also, a shaft 20*a* may be secured to the support plate 24. In such case, the release of the transfer medium transport path may be effected over a wider range.

Figure 7:
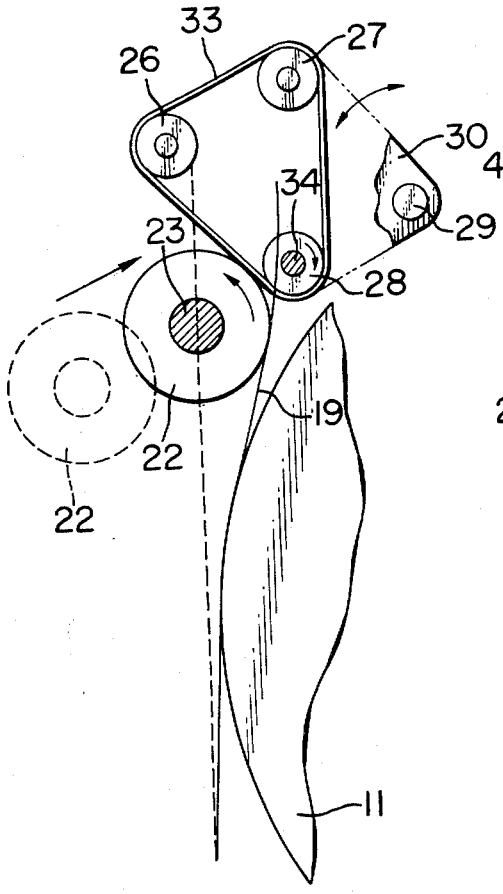
FIG. 7 is a side view showing a further embodiment of the present invention.

The embodiment shown in FIG. 7 differs in the keep mechanism from the embodiment of FIG. 2. More specifically, in the embodiment of FIG. 2, the keep member 20 is provided on the support plate, whereas in the embodiment now under discussion the separation roller serves also as the keep member and the support member 34 for the pulley 28 over which the separation belt is passed acts also as the release member for the separation guide. That is, the release member is provided on the second support plate.

In FIG. 7, reference numeral 11 designates the photosensitive drum, 22 the separation roller serving also as the keep member, and 33 the separation belt. A pulley support member 34 is provided on a shaft integral with the center shaft of the pulley 28. With this construction, the separation guide 19, which assumes the phantom line position before installation, assumes the solid line position by the movement of the separation roller 22 from the broken line position to the solid line position.

In this instance, unlike the embodiment shown in FIGS. 5 and 6, the separation roller 22 softly engages the separation guide 19, thus eliminating the problem of friction.

Figure 8:
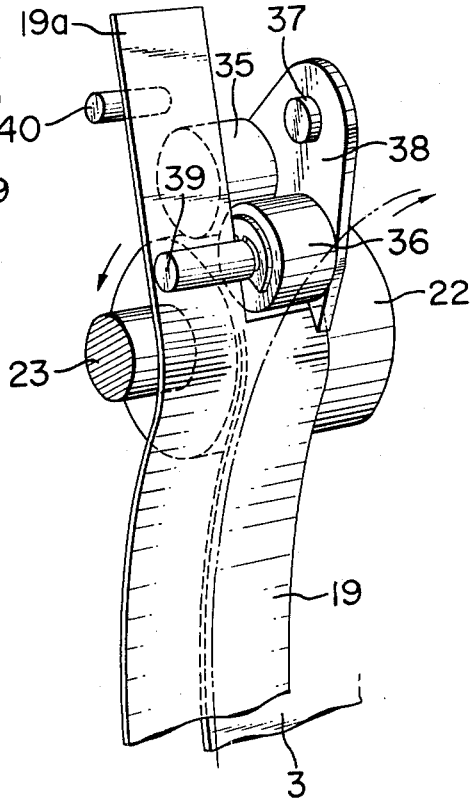
FIG. 8 is a perspective view of an embodiment using auxiliary rollers.

As shown in FIG. 8, the separation belt may be replaced by auxiliary rollers 35 and 36. These auxiliary rollers 35 and 36 are installed on a support plate 38 pivotable about a shaft 37. A keep member 39 is provided on the support plate 38 side, and a release member 40 is provided on a support plate (not shown) which supports the separation roller 22. Again in this embodiment, part of the free end 19*a* of the separation guide 19 is provided just short of the auxiliary separation rollers.

As described hitherto, in the supporting mechanism of the present invention, by setting the mechanism to its operative condition, the guide thereof makes sufficiently intimate contact with the latent image bearing member to thereby automatically accomplish good condition, thus eliminating the need to effect cumbersome positioning and attachment work. Also, by removing the rotary shaft of the fixed end, replacement of the separation guide can be accomplished with ease.

Further, the free end of the separation guide is supported from its both sides by the keep member and the release member and this ensures the separation guide to be held without fail. Therefore, after the image transfer has been completed, the transfer medium is quickly separated from the drum by the separation guide and directed to the separation roller. Still further, the provision of the release member enables the separation guide to be quickly spaced apart from the photosensitive drum when the transfer medium transport path is released.

Furthermore, by dividing the separating mechanism into the separation roller portion and the separation belt portion and making them as a unit each, the incorporation thereof during the manufacturing process becomes easier. In addition, the parts made as a unit can be divided into upper and lower and right and left portions with the path of the transfer paper as the boundary, by pivoting or moving these parts, and this facilitates replacement of parts and cleaning of the apparatus. If jam should arise in the image transfer station or in the separating station because of oblique movement of transfer paper or a plurality of transfer mediums being fed, the route of the paper may be divided to thereby simply enable removal of the transfer paper. Further, the fact that part of the separation guide adjacent to the free end thereof is provided just short of the separation belt or the auxiliary rollers ensures the transfer paper to be nipped by and between the separation roller and the separation belt or the auxiliary rollers. This may prevent transfer paper from deviating from its predetermined transport path to cause jam therein.

What we claim is:

1. A separating mechanism having a separation guide disposed between an image bearing member and a side edge of transfer medium to direct the transfer medium away from the image bearing member, said separation guide being disposed adjacent to or in contact with said image bearing member with one end thereof as a supported end and the other end as a free end, a first bearing member adapted to bear against the free end of said separation guide from the non-image bearing member side and a second bearing member adapted to bear against the free end of said separation guide from the image bearing member side, said free end of said separation guide being supported by said first and second bearing members.

2. A separating mechanism according to claim 1, wherein said first and second bearing members are restraining members provided on a first support plate pivotable about a fixed shaft.

3. A separating mechanism according to claim 2, wherein said first support plate supports a corona discharger.

4. A separating mechanism having a separation roller, a separation guide disposed between an image bearing member and a side edge of transfer medium to direct the transfer medium away from the image bearing member, said separation guide having one end as a supported end and the other end as a free end, a first bearing member adapted to bear against the free end of said separation guide from the non-image bearing member side, a second bearing member adapted to bear against the free end of said separation guide from the image bearing member side, and a member adapted to bear against said separation roller to nip and transport said transfer medium, said separation guide and said first and second bearing members being installed on a first support plate pivotally mounted to a fixed shaft for pivotal movement between an inoperative position and an operative position adjacent the transport path of the transfer medium.

5. A separating mechanism according to claim 4, wherein said separation roller is installed on said first support plate.

6. A separating mechanism according to claim 4 or 5, wherein said member for nipping and transporting said transfer medium is installed on a second support plate pivotally mounted to a fixed shaft distinct from said fixed shaft of said first support plate for pivotal movement between an inoperative position and an operative position adjacent the transport path of the transfer medium.

7. A separating mechanism according to claim 4 or 5, wherein said first bearing member supporting the free end of said separation guide is a separation roller provided on the first support plate pivotable about said fixed shaft.

8. A separating mechanism according to claim 4 or 5, wherein said member for nipping and transporting the transfer medium is a belt.

9. A separation mechanism according to claim 4 or 5, wherein said member for nipping and transporting the transfer medium is a roller.

* * * * *